US010829272B2

(12) United States Patent
Bergman et al.

(10) Patent No.: US 10,829,272 B2
(45) Date of Patent: Nov. 10, 2020

(54) ERGONOMIC CONTAINER WITH THUMB HOLE

(71) Applicant: Bercom International, LLC, Chanhassen, MN (US)

(72) Inventors: Mark W. Bergman, Minnetonka, MN (US); Jeffrey T. Given, St. Paul, MN (US); Matthew V. Leyden, St. Paul, MN (US); Jeffrey B. Waffensmith, North Oaks, MN (US)

(73) Assignee: BERCOM INTERNATIONAL, LLC, Chanhassen, MN (US)

( * ) Notice: Subject to any disclaimer, the term of this patent is extended or adjusted under 35 U.S.C. 154(b) by 183 days.

(21) Appl. No.: 16/127,658

(22) Filed: Sep. 11, 2018

(65) Prior Publication Data

US 2019/0077545 A1 Mar. 14, 2019

Related U.S. Application Data

(60) Provisional application No. 62/558,480, filed on Sep. 14, 2017.

(51) Int. Cl.
*B65D 25/30* (2006.01)
*B65D 1/26* (2006.01)
(Continued)

(52) U.S. Cl.
CPC ..... *B65D 25/30* (2013.01); *B44D 3/12* (2013.01); *B65D 1/26* (2013.01); *B65D 1/40* (2013.01);
(Continued)

(58) Field of Classification Search
CPC ..... B65D 25/30; B65D 25/2888; B65D 25/2882; B65D 25/2802; B65D 25/28;
(Continued)

(56) References Cited

U.S. PATENT DOCUMENTS 606,100 A 6/1898 Thompson
D33,891 S 1/1901 Kennedy
(Continued)

FOREIGN PATENT DOCUMENTS

GB 195523 4/1923
JP 10287339 10/1998

OTHER PUBLICATIONS

One Stroke Palette, from archive.org (accessed Jul. 8, 2020) at URL: https://web.archive.org/web/20150318220339/http://hofcraft.com/onestrokepaintingaccessories.htm, dated Mar. 18, 2015.
(Continued)

*Primary Examiner* — Robert J Hicks
(74) *Attorney, Agent, or Firm* — Mai-Tram D. Lauer; Westman, Champlin & Koehler, P.A.

(57) ABSTRACT

An apparatus includes a bottom wall, a plurality of connected walls attached to the bottom wall to define a cavity having a top rim, and a flange extending laterally outward from the top rim. At least a portion of the flange extends downwardly from the top rim. The portion of the flange includes an aperture configured to accept a user's thumb, and the portion of the flange is substantially symmetrical about a center line of the apparatus.

14 Claims, 14 Drawing Sheets

(51) Int. Cl.

| | |
|---|---|
| ***B65D 25/28*** | (2006.01) |
| ***B65D 1/40*** | (2006.01) |
| ***B65D 25/22*** | (2006.01) |
| ***B44D 3/12*** | (2006.01) |

(52) U.S. Cl.
CPC ..... *B65D 25/22* (2013.01); *B65D 25/2888* (2013.01)

(58) Field of Classification Search
CPC . B65D 25/22; B65D 1/40; B65D 1/26; B44D 3/126; B44D 3/12
USPC ..... 220/771, 770, 755, 769, 675, 669, 657, 220/656, 570, 696, 695; 206/557, 564, 206/1.9, 1.8, 1.7
See application file for complete search history.

(56) References Cited

U.S. PATENT DOCUMENTS

| | | | |
|---|---|---|---|
| 1,304,415 | A | 5/1919 | Tucker |
| 1,590,572 | A | 6/1926 | Fredette |
| 1,734,976 | A | 11/1929 | McClellan |
| 1,813,670 | A | 7/1931 | Kessler |
| 1,950,505 | A | 3/1934 | Matters |
| 2,314,835 | A | 12/1940 | Johns et al. |
| 2,228,536 | A | 1/1941 | Scalph |
| 2,626,737 | A | 1/1953 | Pitz |
| 2,661,858 | A | 12/1953 | Howell |
| 2,709,540 | A | 5/1955 | Kenney |
| 2,712,668 | A | 7/1955 | Thiele |
| D175,865 | S | 10/1955 | Stone |
| 2,765,969 | A | 10/1956 | Bennington |
| D184,315 | S | 1/1959 | Jennings et al. |
| 2,922,176 | A | 1/1960 | Bernhardt |
| 2,963,003 | A | 12/1960 | Oberg et al. |
| 3,014,616 | A | 12/1961 | Kavanaugh et al. |
| 3,014,621 | A | 12/1961 | Povitz |
| D193,382 | S | 8/1962 | Goetz |
| 3,138,280 | A | 6/1964 | Shafer |
| 3,139,646 | A | 7/1964 | Vernon |
| 3,157,902 | A | 11/1964 | Hardwick |
| D202,134 | S | 8/1965 | Bryan |
| 3,219,233 | A | 11/1965 | Whiteford |
| 3,229,820 | A | 1/1966 | Hentzi et al. |
| 3,292,815 | A | 12/1966 | Smith |
| 3,311,252 | A | 3/1967 | Swartwood et al. |
| 3,341,876 | A | 9/1967 | Campbell |
| D208,969 | S | 10/1967 | Paxton |
| 3,351,970 | A | 11/1967 | Engh |
| D211,611 | S | 7/1968 | Fox, Jr. et al. |
| D212,831 | S | 11/1968 | Koch |
| 3,425,012 | A | 1/1969 | Gottinger |
| D216,277 | S | 12/1969 | James |
| 3,536,285 | A | 10/1970 | Vaughn |
| 3,590,416 | A | 7/1971 | Henningsen |
| 3,595,431 | A | 7/1971 | Bird |
| 3,602,939 | A | 9/1971 | Schoenholz |
| D223,864 | S | 6/1972 | Vines |
| 3,682,352 | A | 8/1972 | Douchette |
| 3,707,242 | A | 12/1972 | Golden |
| 3,729,158 | A | 4/1973 | Nagy |
| 3,828,389 | A | 8/1974 | Heisler |
| 3,837,034 | A | 9/1974 | Leffert |
| 3,940,824 | A | 3/1976 | Gioia et al. |
| 3,947,135 | A | 3/1976 | Hawk |
| 4,023,702 | A | 5/1977 | McKnight |
| 4,061,242 | A | 12/1977 | Donlon |
| 4,101,046 | A | 7/1978 | Puntillo |
| 4,145,789 | A | 3/1979 | Morgan, Sr. |
| 4,164,299 | A | 8/1979 | Fuhr |
| D254,482 | S | 3/1980 | Bell |
| D270,961 | S | 10/1983 | Hawkins et al. |
| 4,445,250 | A | 5/1984 | Seidl |
| D277,080 | S | 1/1985 | Gagnon |
| 4,519,565 | A | 5/1985 | Whitmore |
| 4,627,546 | A | 12/1986 | Carranza |
| D289,452 | S | 4/1987 | Fuller |
| D291,612 | S | 8/1987 | Inui |
| 4,691,840 | A | 9/1987 | Ferbrache |
| 4,798,307 | A | 1/1989 | Evrard |
| D301,785 | S | 6/1989 | Goetz |
| D302,614 | S | 8/1989 | Beatty |
| 4,860,891 | A | 8/1989 | Biggio |
| D305,467 | S | 1/1990 | Dagge |
| 4,895,269 | A | 1/1990 | Cade |
| 4,927,046 | A | 5/1990 | Armstrong |
| 4,928,873 | A | 5/1990 | Johnson |
| 5,011,536 | A | 4/1991 | Boom |
| 5,033,704 | A | 7/1991 | Kerr |
| 5,083,733 | A | 1/1992 | Marino et al. |
| 5,092,481 | A | 3/1992 | Skelton |
| 5,147,067 | A | 9/1992 | Effertz |
| 5,169,025 | A | 12/1992 | Guo |
| 5,201,439 | A | 4/1993 | Davies |
| 5,207,348 | A | 5/1993 | Fischer et al. |
| 5,222,656 | A | 6/1993 | Carlson |
| 5,308,181 | A | 5/1994 | Hull et al. |
| 5,320,249 | A | 6/1994 | Strech |
| 5,320,279 | A | 6/1994 | Giblin et al. |
| 5,341,969 | A | 8/1994 | Accardo et al. |
| D350,632 | S | 9/1994 | Cummins |
| D353,241 | S | 12/1994 | Breen |
| D353,697 | S | 12/1994 | Breen et al. |
| 5,400,916 | A | 3/1995 | Weber |
| 5,429,262 | A | 7/1995 | Sharkey |
| 5,493,751 | A | 2/1996 | Misiukowiec et al. |
| 5,511,279 | A | 4/1996 | Ippolito |
| 5,549,216 | A | 8/1996 | Scholl |
| 5,570,807 | A | 11/1996 | Busch |
| 5,624,093 | A | 4/1997 | Gemmell |
| 5,641,087 | A | 6/1997 | Moffitt |
| D390,596 | S | 2/1998 | Domhoff et al. |
| 5,746,346 | A | 5/1998 | Crilly |
| D395,531 | S | 6/1998 | Mandell et al. |
| D397,833 | S | 9/1998 | Adams Zurawin |
| 5,810,196 | A | 9/1998 | Lundy |
| RE35,933 | E | 10/1998 | Scholl |
| D401,116 | S | 11/1998 | Demore |
| 5,836,469 | A | 11/1998 | Zebrowski |
| 5,899,354 | A | 5/1999 | Garcia |
| D415,864 | S | 10/1999 | Axhamre |
| 5,971,201 | A | 10/1999 | Daw |
| 6,019,241 | A | 2/2000 | Burns |
| D422,450 | S | 4/2000 | Conti |
| D423,729 | S | 4/2000 | Morgan |
| 6,065,633 | A | 5/2000 | Abbey |
| 6,119,303 | A | 9/2000 | Passafiume |
| 6,138,963 | A | 10/2000 | Malvasio |
| D435,728 | S | 1/2001 | Miles et al. |
| D444,604 | S | 7/2001 | Hoffert et al. |
| D444,929 | S | 7/2001 | Cox |
| 6,260,730 | B1 | 7/2001 | Fellman |
| 6,276,554 | B1 | 8/2001 | Lallement et al. |
| D452,130 | S | 12/2001 | Richardson |
| D453,243 | S | 1/2002 | Burke |
| D458,723 | S | 6/2002 | Malvasio |
| D460,845 | S | 7/2002 | Bergman |
| 6,419,106 | B1 | 7/2002 | Bebak |
| D462,902 | S | 9/2002 | Gittins et al. |
| 6,449,829 | B1 | 9/2002 | Malvasio et al. |
| D466,407 | S | 12/2002 | Nance |
| D466,787 | S | 12/2002 | Clancy |
| D467,784 | S | 12/2002 | Maier |
| D469,233 | S | 1/2003 | Begnani |
| 6,622,340 | B2 | 9/2003 | Rosa |
| D482,274 | S | 11/2003 | Walsh et al. |
| D482,830 | S | 11/2003 | Kohn |
| D483,917 | S | 12/2003 | Frantz |
| 6,708,838 | B2 | 3/2004 | Bergman et al. |
| D492,196 | S | 6/2004 | Hyhlik et al. |
| D493,035 | S | 7/2004 | Bergman |
| 6,802,431 | B2 | 10/2004 | Schinkel |
| D499,027 | S | 11/2004 | Walsh et al. |

(56) References Cited

U.S. PATENT DOCUMENTS

| | | | | |
|---|---|---|---|---|
| 6,827,233 | B1 | 12/2004 | Scallate | |
| D509,420 | S | 9/2005 | Hauber | |
| 6,991,829 | B2 | 1/2006 | Bergman | |
| 6,996,872 | B2 | 2/2006 | Tennant | |
| 7,000,799 | B1 * | 2/2006 | Hamre | A47G 19/065 220/23.8 |
| D518,263 | S | 3/2006 | Verhaar | |
| D524,501 | S | 7/2006 | Prokop et al. | |
| D526,748 | S | 8/2006 | Van Skiver | |
| 7,083,044 | B1 | 8/2006 | Kilian et al. | |
| D528,706 | S | 9/2006 | Jefferson | |
| D535,794 | S | 1/2007 | Lundy et al. | |
| 7,191,913 | B2 | 3/2007 | Byrne | |
| D546,160 | S | 7/2007 | Reithmeyer | |
| D546,514 | S | 7/2007 | Byrne | |
| D548,913 | S | 8/2007 | Van Landingham | |
| D549,913 | S | 8/2007 | Bergman | |
| D553,818 | S | 10/2007 | Moon | |
| D562,518 | S | 2/2008 | Lundy | |
| D569,567 | S | 5/2008 | Kohn | |
| D571,969 | S | 6/2008 | Byers | |
| D578,874 | S | 10/2008 | Smith et al. | |
| D581,118 | S | 11/2008 | Bergman | |
| D583,521 | S | 12/2008 | Arvinte et al. | |
| D586,056 | S | 2/2009 | Shea | |
| D594,163 | S | 6/2009 | Sparano | |
| D607,624 | S | 1/2010 | Bergman | |
| D612,119 | S | 3/2010 | Bergman | |
| D617,517 | S | 6/2010 | Bergman | |
| 7,963,418 | B2 | 6/2011 | Arvinte et al. | |
| D645,627 | S | 9/2011 | Arvinte et al. | |
| D654,644 | S | 2/2012 | Davidson | |
| D692,198 | S | 10/2013 | Bergman | |
| 8,556,116 | B2 | 10/2013 | Bergman et al. | |
| D694,976 | S | 12/2013 | Lambertson | |
| 8,919,604 | B2 | 12/2014 | Bergman et al. | |
| D728,884 | S | 5/2015 | Waffensmith et al. | |
| D744,186 | S | 11/2015 | Gringer et al. | |
| D744,711 | S | 12/2015 | Gringer et al. | |
| 2002/0005409 | A1 | 1/2002 | Rose | |
| 2002/0036206 | A1 | 3/2002 | Bergman et al. | |
| 2002/0056714 | A1 | 5/2002 | Schinkel | |
| 2004/0118861 | A1 | 6/2004 | Bergman et al. | |
| 2004/0134917 | A1 | 7/2004 | Carnegie | |
| 2004/0173622 | A1 | 9/2004 | Findleton | |
| 2004/0195248 | A1 | 10/2004 | Garcia | |
| 2004/0206761 | A1 | 10/2004 | Frantz | |
| 2004/0208083 | A1 | 10/2004 | Armendariz et al. | |
| 2004/0256335 | A1 | 12/2004 | Sholem | |
| 2006/0124649 | A1 | 6/2006 | Campbell | |
| 2006/0219720 | A1 | 10/2006 | Lundy et al. | |
| 2006/0225959 | A1 | 10/2006 | Pohl | |
| 2006/0226154 | A1 | 10/2006 | Lundy et al. | |
| 2006/0243732 | A1 | 11/2006 | Bergman | |
| 2007/0204423 | A1 * | 9/2007 | Keane | B44D 3/12 15/257.06 |
| 2014/0008377 | A1 | 1/2014 | Findleton | |
| 2016/0185155 | A1 * | 6/2016 | Bergman | B44D 3/128 15/257.06 |

OTHER PUBLICATIONS

Snack Palette, from achive.org (accessed Jul. 8, 2020) at URL: https://web.archive.org/web/20100101160016/http://www.snackpalette.com/, dated Jan. 1, 2010.

Tupperware Thatsa(r) Bowls, product information, dated Oct. 9, 2014.

Pampered Chef Stainless Steel Mixing Bowl set, from archive.org (accessed Jul. 8, 2020) at URL: https://web.archive.org/web/20160624103115/https://www.pamperedchef.com/shop/Cook%27s+Tools/Mixing+26+Measuring/Stainless+Steel+Mixing+Bowl+Set/1735, dated Jun. 24, 2016.

Painters' Helper Sporty's Tool Shop (1 page) bearing copyright notice of 2001.

Fourteen (14) pages of photos of a pail known to the public prior to Apr. 29, 2004.

Purdy Product Catalog, pp. 1, 3, 6, 52, 54-56, 60, Jan. 2013.

Purdy press release "Purdy dual roll off five-gallon bucket increases production speed for professional painters," (2 pages) Jan. 2013.

Description of "Dual Roll Off Bucket" from www.purdy.com, (1 page) printed Sep. 10, 2013.

Description of "Dual Roll Off Bucket" from www.purdy.com, (1 page) printed Nov. 18, 2013.

Three (3) photos of a Monarch Handy Paint Pot with liners, obtained Feb. 23, 2016.

Four (4) photos of containers with thumb features, obtained Feb. 13, 2017.

* cited by examiner

ERGONOMIC CONTAINER WITH THUMB HOLE

CROSS REFERENCE TO RELATED APPLICATION

This application claims the benefit of priority from U.S. provisional patent application No. 62/588,480, filed on Sep. 14, 2017, the content of which is fully incorporated by reference herein.

BACKGROUND

This disclosure relates to a holding vessel and more particularly to a hand-held container with a thumb hole by which a user's hand is engaged to the container.

Hand-held vessels, containers, or bowls are utilized for holding a variety of materials or fluids. Typically, a handle is provided, which allows a user to carry or hold the container without contacting its contents. This is particularly beneficial in the case when the fluid is potentially toxic or hazardous to a person's skin. A portable, hand-held container is useful in many commercial or household applications and is especially useful in painting applications.

In the field of painting, there has long been a problem regarding how to comfortably hold and carry a quantity of paint and a paintbrush for an extended period of time and on a unstable surface, such as while climbing a ladder, working on a scaffold, or while standing on the roof of a building. One approach to this problem has been to use a light-weight paper bucket capable of holding around a gallon of paint. These buckets, however, have no handle. Typically, such a paper bucket is gripped with the thumb and fingers by the rim and side, which is tiring, or it is cradled against a user's body (e.g., in the crook of a user's arm), which is awkward and inconvenient.

Another approach to the problem is to use a metal or plastic bucket with a bail-type handle as disclosed in U.S. Pat. No. 3,595,431 to Bird. This approach, while affording a more versatile mode of holding a paint bucket, is awkward for dipping a paintbrush into the paint when the bucket is being suspended from the handle since the user's hand tends to be in the way. An alternative approach, as disclosed in U.S. Pat. No. 4,927,046 to Armstrong, is to support the paint container with the fingers of the user's hand in a compartment provided in the bottom of the container, and to hook the user's thumb into the handle. A similar approach disclosed in U.S. Pat. No. 4,164,299 to Fuhr, which shows a paint tray supported with the user's fingers in a compartment in the bottom of the tray while the thumb stabilizes the tray on a tab. These alternative approaches do not sufficiently stabilize the paint container with respect to the user's hand, thereby increasing the likelihood of inadvertently spilling paint during the painting process. In addition, these approaches tend to cause undue muscle fatigue in the fingers that support the paint container.

Many of the known prior art hand-held containers are difficult to hold in close proximity to the user's other hand or work area without exerting considerable effort. Few of the prior art containers offer a comfortable, stable and secure hand-held container for carrying, holding, and transferring fluids or other loose materials (e.g., granular materials such as bird seed, coffee beans, ground coffee and the like), without exerting considerable effort.

SUMMARY

An apparatus includes a bottom wall, a plurality of connected walls attached to the bottom wall to define a cavity having a top rim, and a flange extending laterally outward from the top rim. At least a portion of the flange extends downwardly from the top rim. The portion of the flange includes an aperture configured to accept a user's thumb, and the portion of the flange is substantially symmetrical about a center line of the apparatus.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. It is contemplated that all descriptions are applicable to like and analogous structures throughout the several embodiments.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

DETAILED DESCRIPTION

Figure 1A:
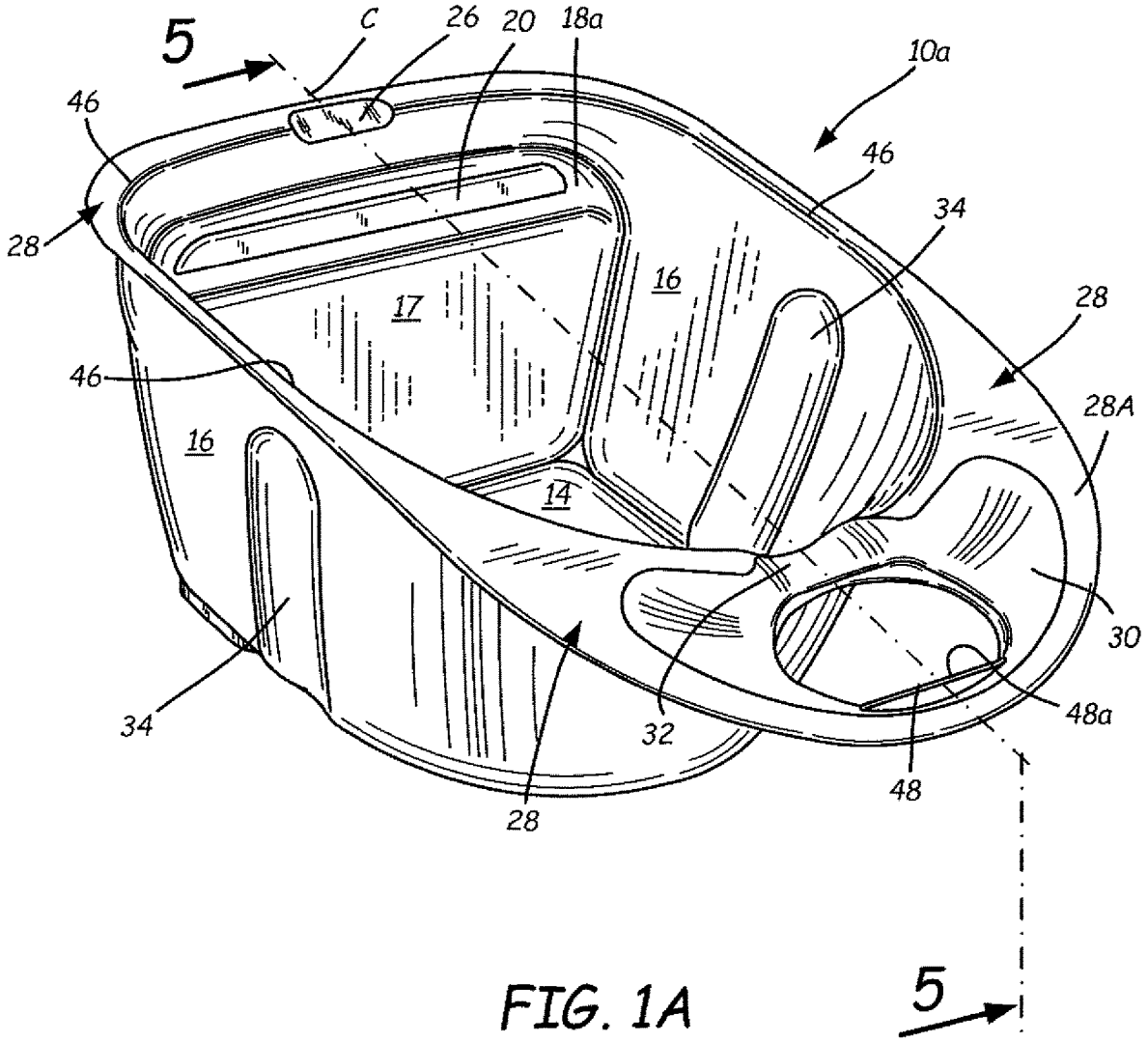
FIG. 1A is a perspective view of a first exemplary embodiment of a container in accordance with the present disclosure.
Figure 1B:
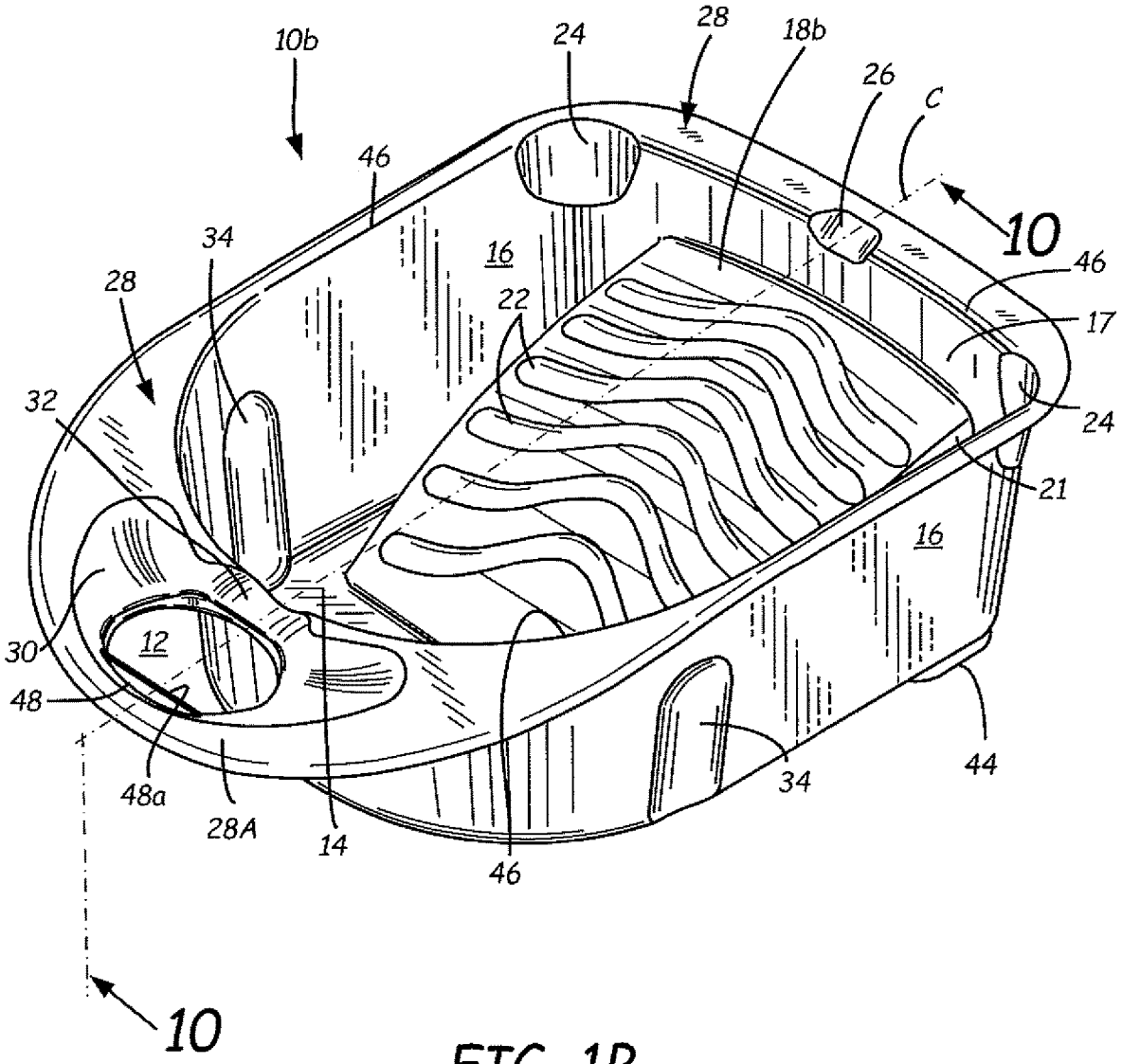
FIG. 1B is a perspective view of a second exemplary embodiment of a container in accordance with the present disclosure.

FIGS. 1A and 1B are perspective views of two exemplary embodiments of an ergonomic container 10*a*, 10*b* having a thumb hole 12. While two specific embodiments of containers 10*a* and 10*b* are illustrated, it is contemplated that the descriptions of features described with reference to these particular containers can also be used for other containers. For example, container 10*a* is specifically designed as a paint holding container to be used with a paint brush. Container 10*b* is specifically designed as a paint container to be used with a paint roller. However, it is to be understood that a container 10 in accordance with the present description can be used to hold other liquids or solids. For example, such an ergonomic container 10 could be used as a feeding bowl for containing food, to be used for example by one with arthritic hands. A feature of the described containers 10 is that the thumb hole 12 allows a user to easily and securely hold onto the container 10 without having to grip a container or its handle with his or her fingers, as would be required with a conventional, non-ergonomic container.

In exemplary embodiments, container 10 is formed from a single material as a unitary structure, thereby being easy to manufacture. In exemplary embodiments, each container 10 is formed by injection molding using a polymer material that can withstand the chemicals used in fluids such as paint, stain, varnish or adhesive. Particularly suitable materials include polypropylene and similar plastics. The thin-walled shell construction of container 10 allows for efficient use of the polymer material. Accordingly, a commercial price of container 10 can be kept low enough that it may be disposed after a single use as a container. For even more economical use, container 10 may be easily cleaned for multiple uses before disposal. Such a shell construction also provides for a light-weight container 10 that offers enhanced ease of use, prevents user fatigue and increases economies in manufacturing and transport. Further, in an exemplary embodiment, the material from which container 10 is manufactured is recycled, such as from car battery cases. Moreover, the material in an exemplary embodiment is non-corrosive, to prevent the formation of rust from repeated use and cleaning.

All references to a container 10 will refer in general to a container having features shown in one or both of the particular embodiments of containers 10*a* and 10*b*. These embodiments have many features in common, and the common features will be referred to with the same or similar reference numbers. While particular embodiments of containers 10*a* and 10*b* are shown, it is contemplated that the features disclosed herein are also applicable to containers of other configurations and sizes.

As shown in FIGS. 1A and 1B, in exemplary embodiments, each of containers 10*a*, 10*b* is an open-top vessel having a bottom wall 14 joined to connected side walls 16 and end wall 17. Inner surfaces of at least bottom wall 14, connected side walls 16 and end wall 17 define a fluid holding cavity having a top rim 46. A fluid wiping surface 18 may extend from end wall 17 and below top rim 46. In container 10*a*, fluid wiping surface 18*a* is configured as a surface that extends laterally from a substantially vertical end wall 17 and has a width that extends between two opposed outer side walls 16. In an exemplary embodiment, a fluid wiping ledge 20 extends upward from surface 18*a*. A user may pull the bristles of a paint brush against fluid wiping ledge 20 to wipe off excess paint. In an exemplary embodiment, fluid wiping ledge 20 does not extend a full width of the surface 18*a* so that any fluid that accumulates forward of ledge 20 can drain by gravity on surface 18*a* and down toward bottom wall 14.

In container lob, fluid wiping surface 18*b* includes a plurality of raised elements that impart a texture to fluid wiping surface 18*b*, such as curvilinear ridges 22. In an exemplary embodiment, each ridge 22 is a curvilinear element having rounded edges, wherein the peak or highest point of the curve is along center line C. Accordingly, paint or another fluid on wiping surface 18*b* is channeled by gravity away from center line C, down inner side walls 21, and back into the pool of fluid in the cavity of container 10*b*. This feature prevents pooling of fluids on wiping surface 18*b*, thereby allowing wiping surface 18*b* to further accept paint applied thereto. While an exemplary pattern for ridges 22 is illustrated, it is contemplated that a textured surface can be provided on wiping surface 18*b* using an array of other raised elements, such as a pattern of bumps or other ridges (that may be round, straight, curved, and/or generally parallel, or any combination thereof). Ridges 22 facilitate uniform distribution of paint on a paint roller and also enhance the aesthetic appearance of container lob.

In exemplary embodiments, the strength of side walls 16 can be enhanced by the provision of ribs 34. For optimal user comfort and aesthetic reasons, many of the components of container 10 are curved. As illustrated in FIGS. 3A-12, side walls 16, end wall 17 and inner side walls 21 incline or cant outwardly from bottom wall 14 so that the containers 10 can be efficiently nested when multiple such containers are stacked upon each other. This allows for the efficient use of space in packaging, transport, retail display and storage functions of multiple such containers 10. Container 10*b* is also shown with corner depressions 24 in top rim 46; depressions 24 can serve as pouring spouts that can facilitate smooth pouring of contents of container 10*b* therefrom. In the illustrated embodiments, each of containers 10*a* and 10*b* includes a notch 26 in top rim 46 configured for acceptance of a portion of a handle of a paint brush or roller. In an exemplary embodiment, corner depressions 24 and notches 26 are provided at least partially on top rim 46 and extending onto top flange 28.

Figure 3A:
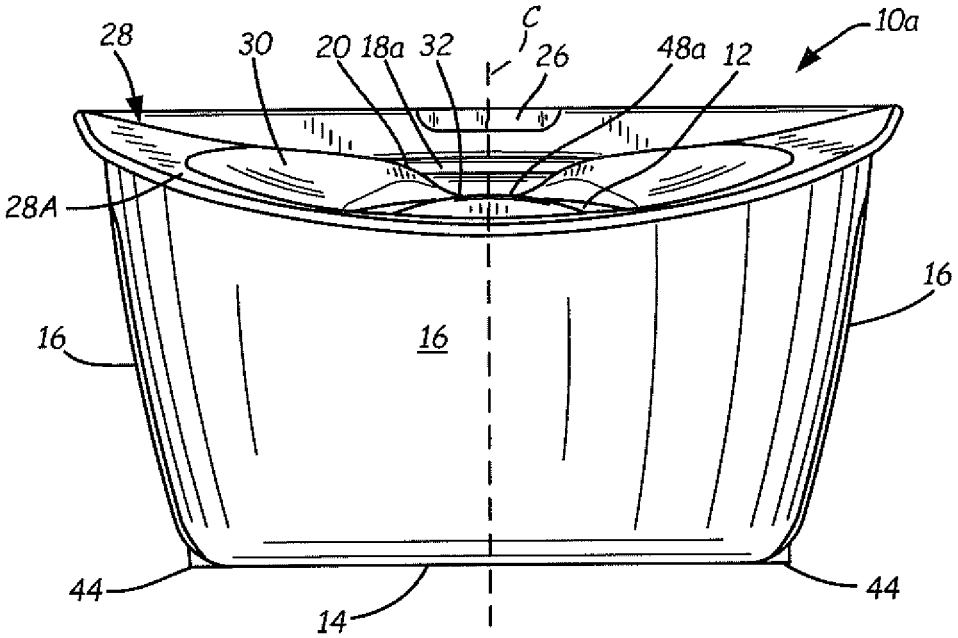
FIG. 3A is a back end elevation view of the container of FIG. 1A.
Figure 3B:
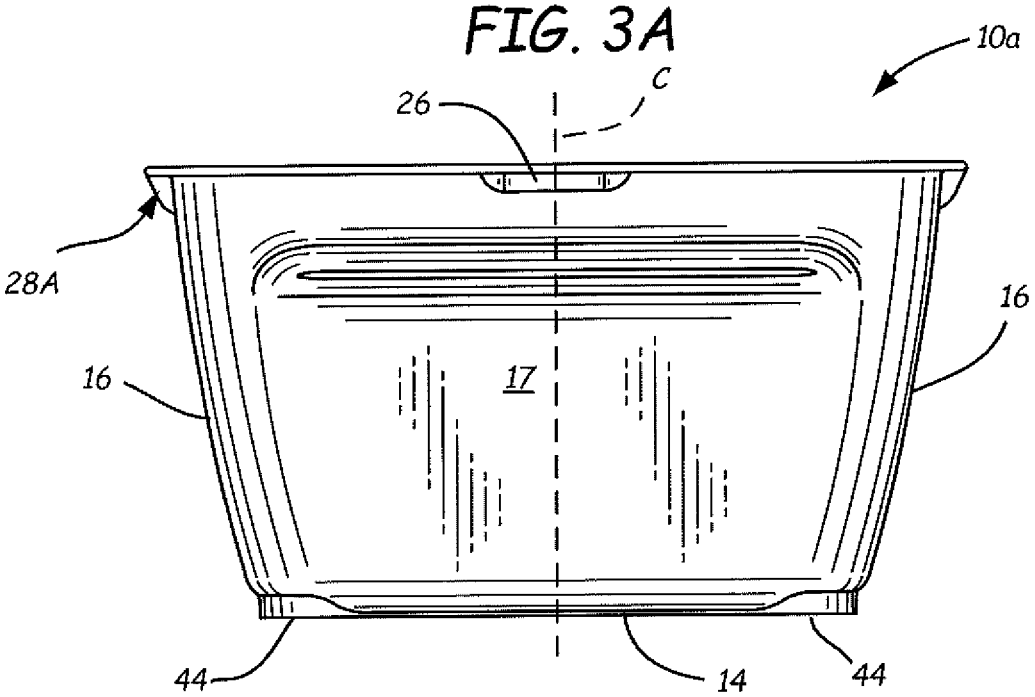
FIG. 3B is a front end elevation view of the container of FIG. 1A.
Figure 4A:
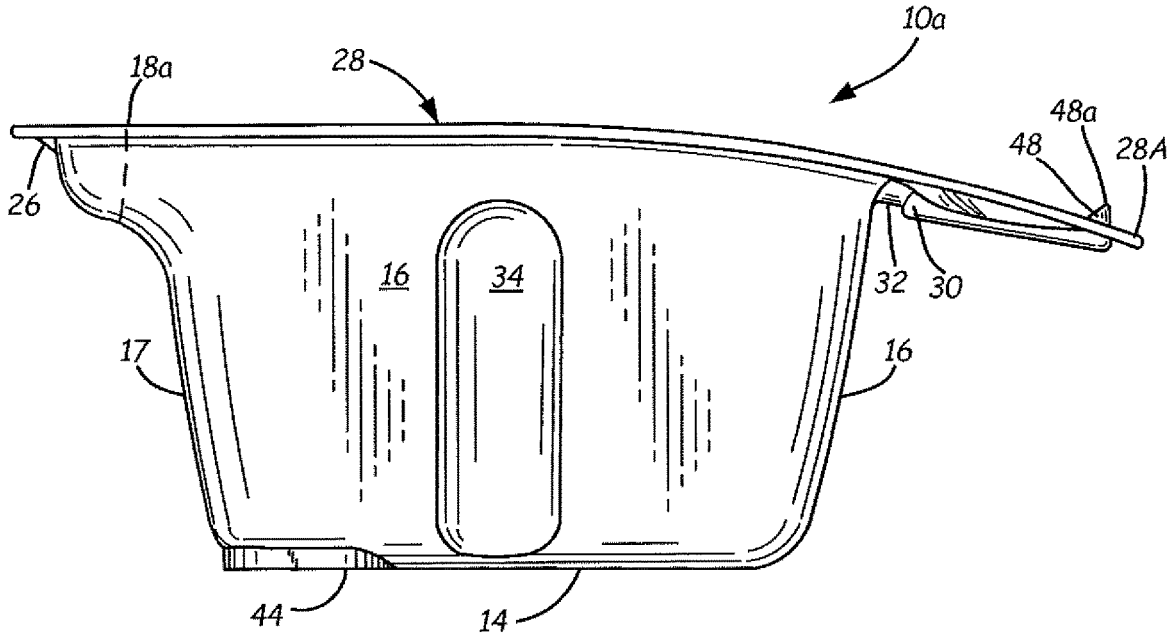
FIG. 4A is a left side elevation view of the container of FIG. 1A (with the "left" direction as shown in FIG. 1A).
Figure 4B:
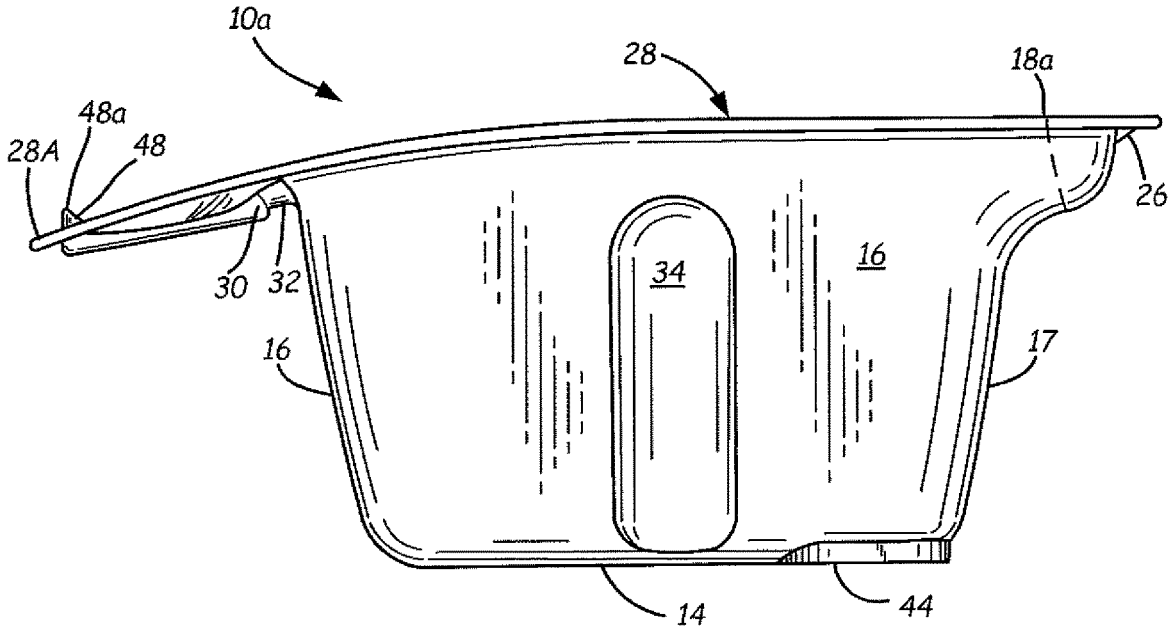
FIG. 4B is a right side elevation view of the container of FIG. 1A (with the "right" direction as shown in FIG. 1A).
Figure 5:
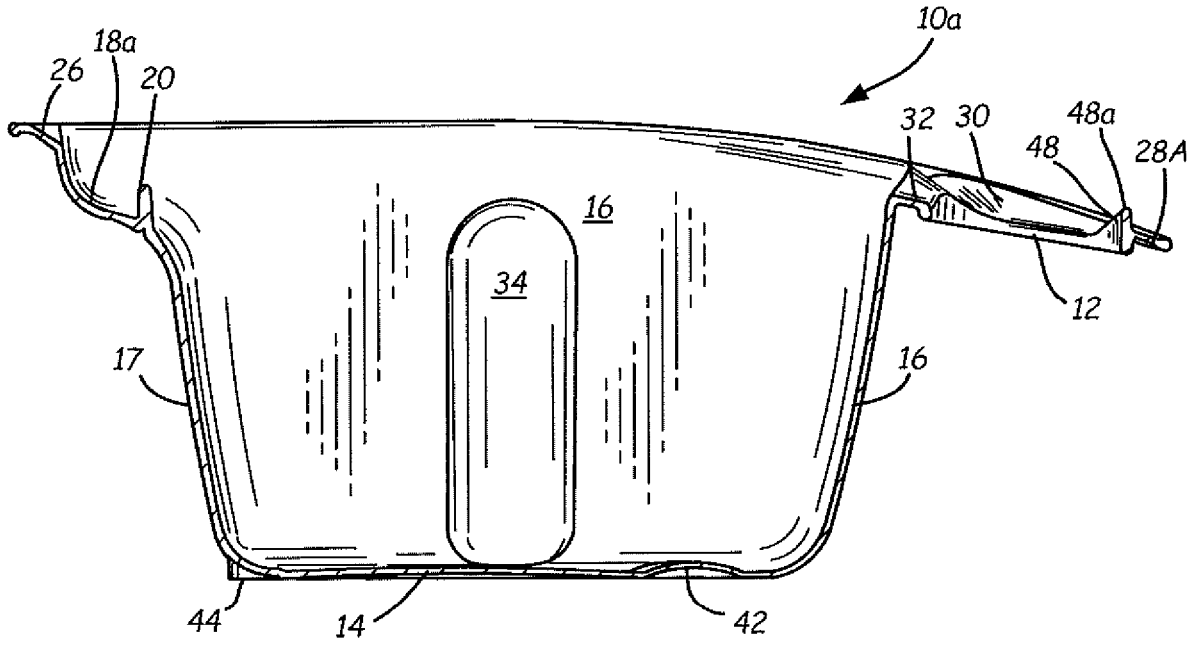
FIG. 5 is a cross-sectional elevation view taken through line 5-5 of FIG. 1A.
Figure 6:
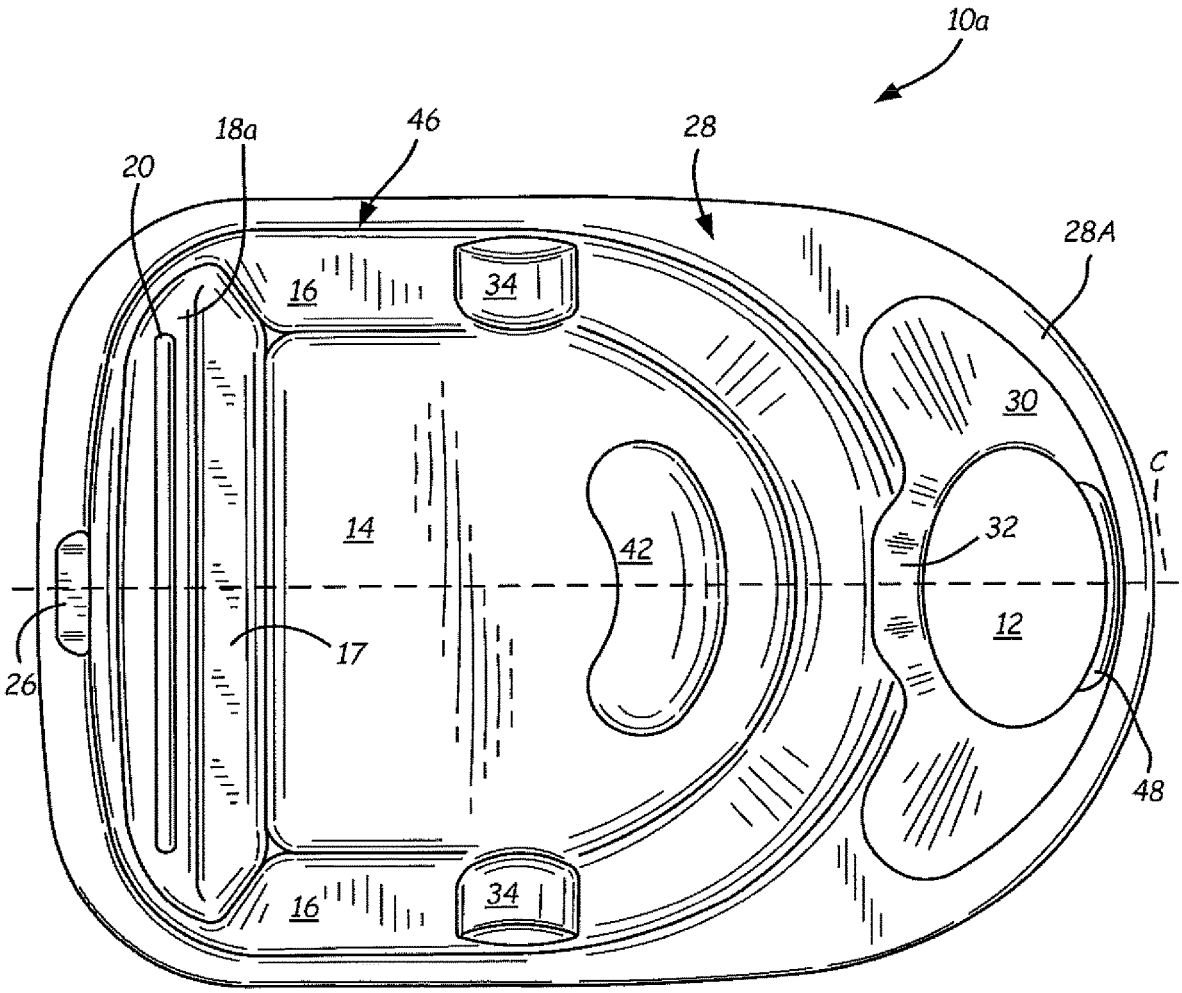
FIG. 6 is a top view of the container of FIG. 1A.

Top flange 28 extends laterally outward from the cavity at top rim 46 and encircles the entire top rim 46 in an illustrated embodiment. Flange 28 is generally flat. However, at the handle end of flange 28, a handle tab portion 28A of flange 28 extends downwardly from top rim 46, as shown in FIGS. 3 and 4. In that handle tab portion 28A, an aperture such as thumb hole 12 is provided at the bottom of a depression 30 that extends downwardly from flange 28. In an exemplary embodiment, a thumb notch 32 is located on top rim 46 and connects thumb hole 12 and the cavity defined in part by side walls 16. In an exemplary embodiment, the handle tab portion 28A of flange 28 curves downward and away from the top rim 46, and the depression 30 curves downward and away from the handle tab portion 28A.

Figure 2A:
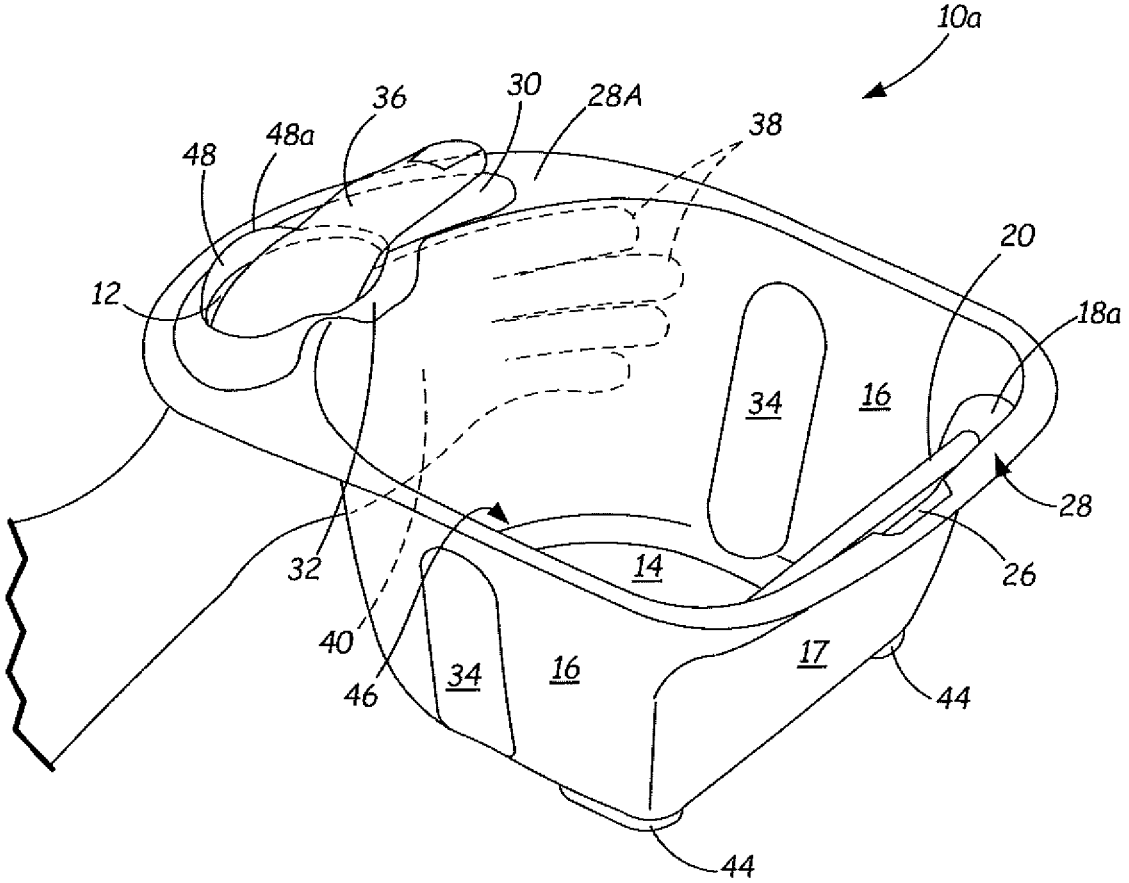
FIG. 2A is a perspective view of the container of FIG. 1A, showing an example of how it may be held by a user.
Figure 2B:
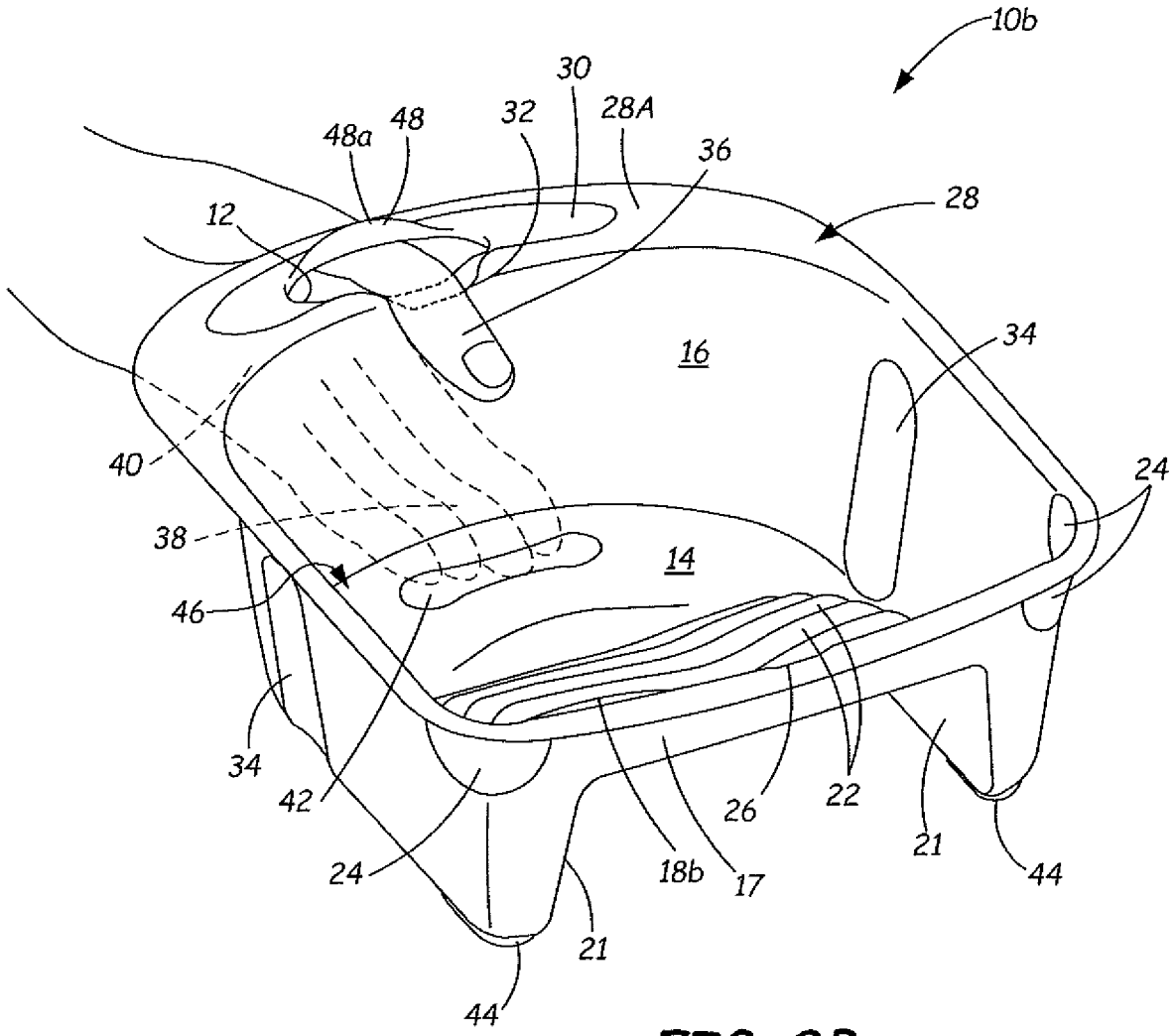
FIG. 2B is a perspective view of the container of FIG. 1B, showing an example of how it may be held by a user.

FIGS. 2A and 2B illustrate two exemplary ways by which a user may hold onto container 10. With respect to container 10*a*, a user is shown with his or her thumb 36 inserted upward through thumb hole 12, with handle tab portion 28A of flange 28 of container 10*a* resting upon the user's fingers 38. In this configuration, the user's palm 40 rests against the outside of sidewall 16. In exemplary embodiments, thumb hole 12 is generally symmetrical relative to center line C (e.g., oval) with smooth surface transitions about its perimeter, and depression 30 has an elongated elliptical shape (also generally symmetrical relative to center line C). As shown in FIGS. 3A, 4A-5, 8A and 9A-10, handle tab portion 28A of flange 28 has a gentle, convex curvature downward toward the end of handle 28 bearing depression 30 and thumb hole 12.

In exemplary embodiments, handle tab portion 28A includes lip 48 that follows the smooth curved perimeter of the thumb hole 12, along an outer portion thereof, and has a smooth curved upper lip edge 48*a* (in exemplary embodiments). The lip 48 aids in stabilizing a user's hand and provides additional curved surfaces for engagement with a user's hand and thumb area, for enhanced comfort. Container 10 in an exemplary embodiment is substantially symmetrical about center line C. Accordingly, while a left hand is illustrated in FIGS. 2A and 2B, it is to be understood that either hand can be used to hold container 10 via the handle tab portion 28A of flange 28. These features are configured to accommodate the curvatures of a user's hand (right hand or left hand). As illustrated, handle tab portion 28A of flange 28 rests comfortably on top of the user's fingers 38, while the user's thumb 36 rests comfortably in depression 30, having been inserted through thumb hole 12 and in contact with portions of the perimeter thereof and, in some cases, with its curved upper lip 48. Accordingly, the user need not expend much muscular effort to hold onto container 10*a*.

In FIG. 2B, with respect to container 10*b*, the illustration shows another method for holding container 10, wherein the thumb is rotated to fit into thumb notch 32, so that the palm 40 and fingers 38 are oriented more vertically with respect to an outer surface of side wall 16. A user may optionally curve his or her fingers 38 so that the finger tips engage upwardly extending recess 42 in a bottom surface of bottom wall 14 (which thus defines an upward protrusion on the inside surface of bottom wall 14). The user can grip container 10 between thumb notch 32 and bottom wall 14 or can merely relax his or her hand during use of the vessel. Portions of the user's hand may engage lip 48, as well as the smoothly curved outer contours of the handle tab portion 28A of the flange 28. Thus, the disclosed container 10 greatly reduces fatigue in the holding hand and fingers of a user while offering flexibility, comfort and support in different orientations in grip. Either container 10 can be held in either of the manners illustrated in FIGS. 2A and 2B, with either hand. Moreover, users may devise other ways to hold container 10.

Figure 7:
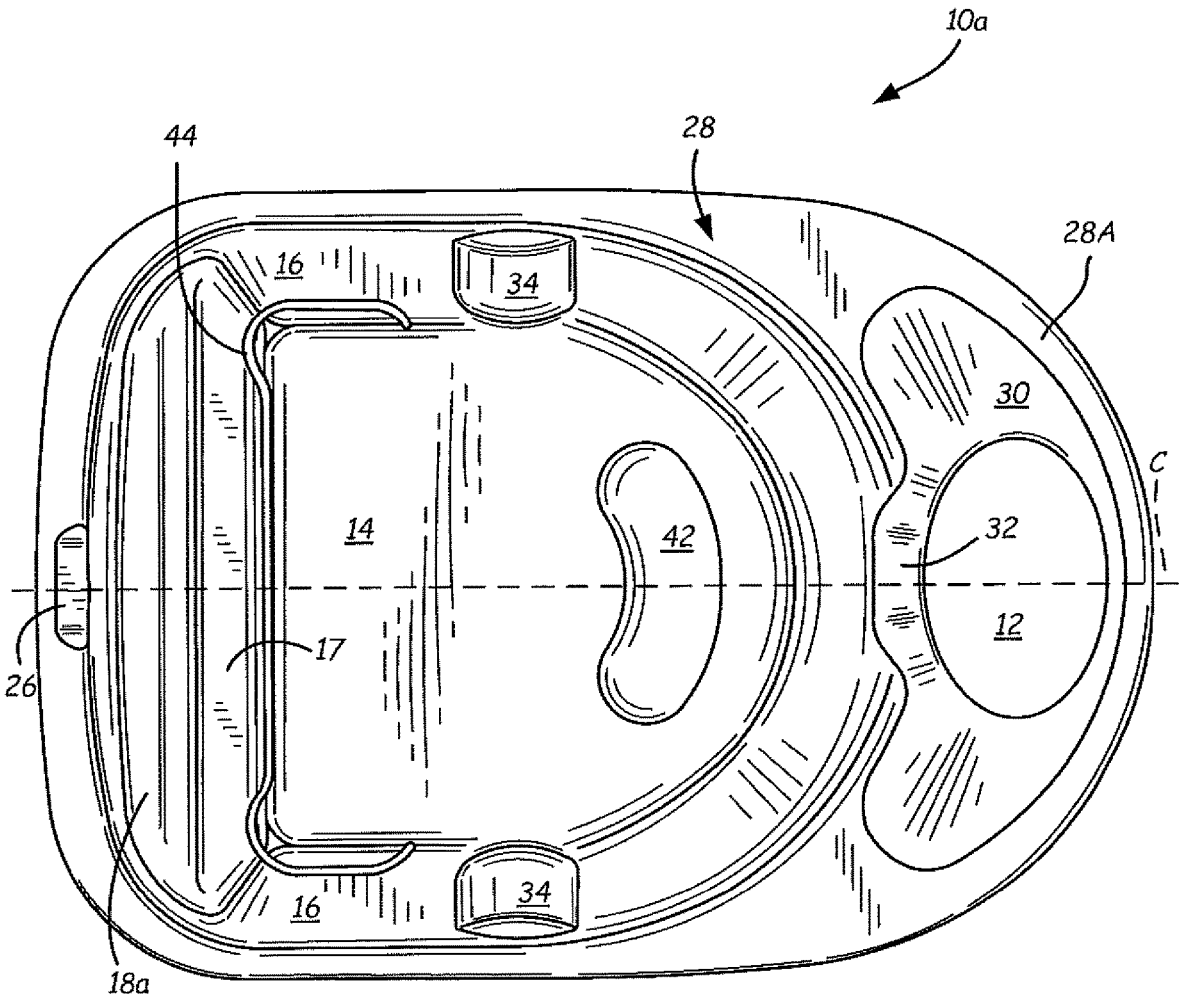
FIG. 7 is a bottom view of the container of FIG. 1A.
Figure 8A:
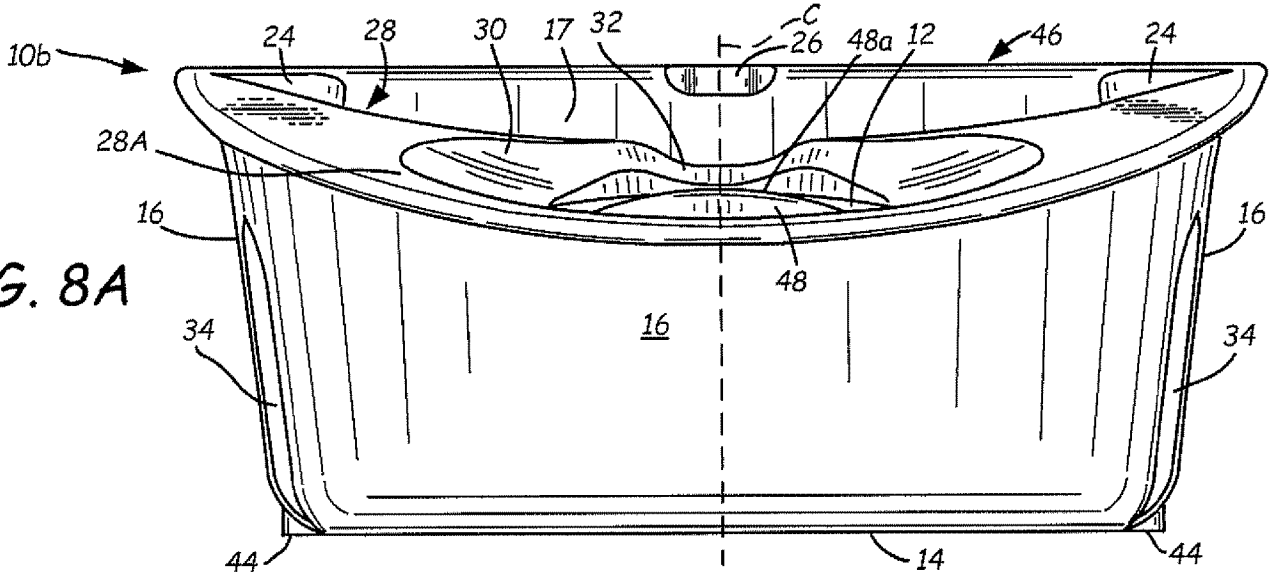
FIG. 8A is a back end elevation view of the container of FIG. 1B.
Figure 8B:
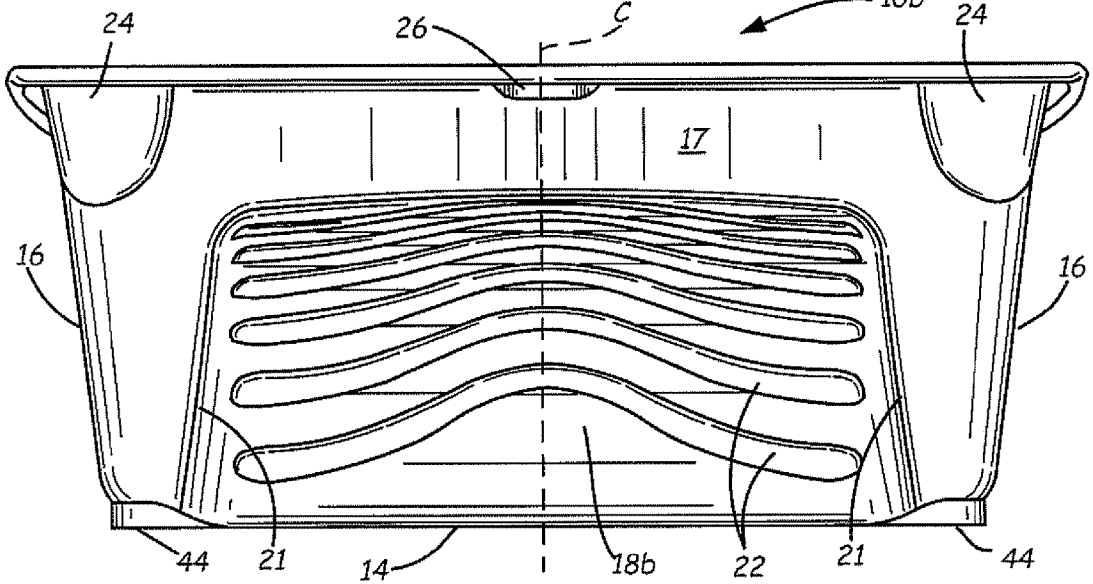
FIG. 8B is a front end elevation view of the container of FIG. 1B.
Figure 9A:
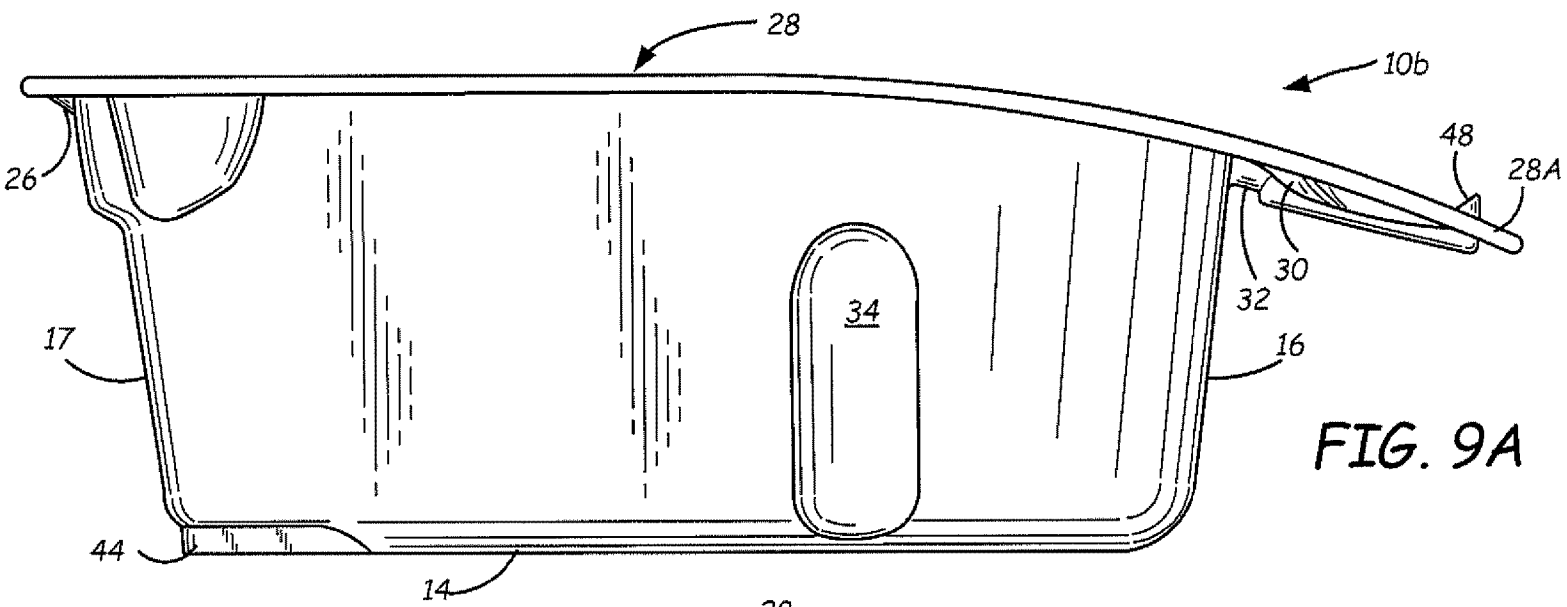
FIG. 9A is a left side elevation view of the container of FIG. 1B (with the "left" direction as shown in FIG. 1B).
Figure 9B:
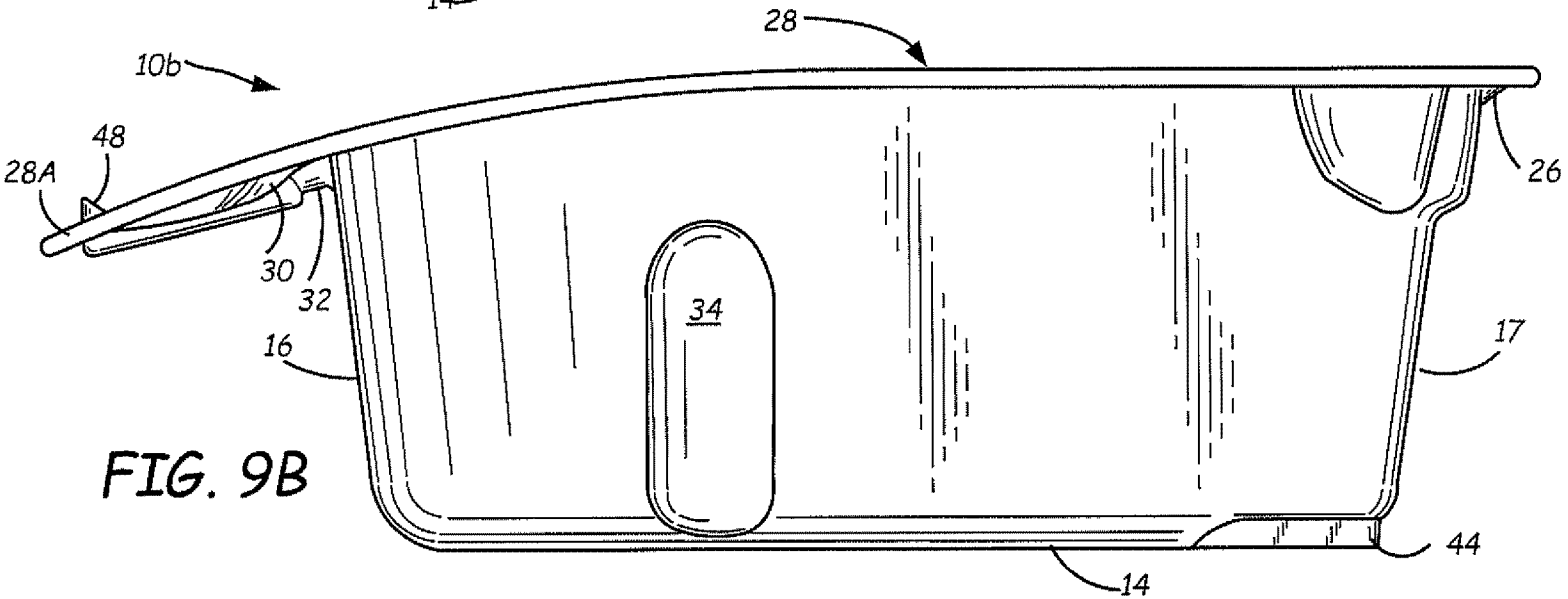
FIG. 9B is a right side elevation view of the container of FIG. 1B (with the "right" direction as shown in FIG. 1B).
Figure 10:
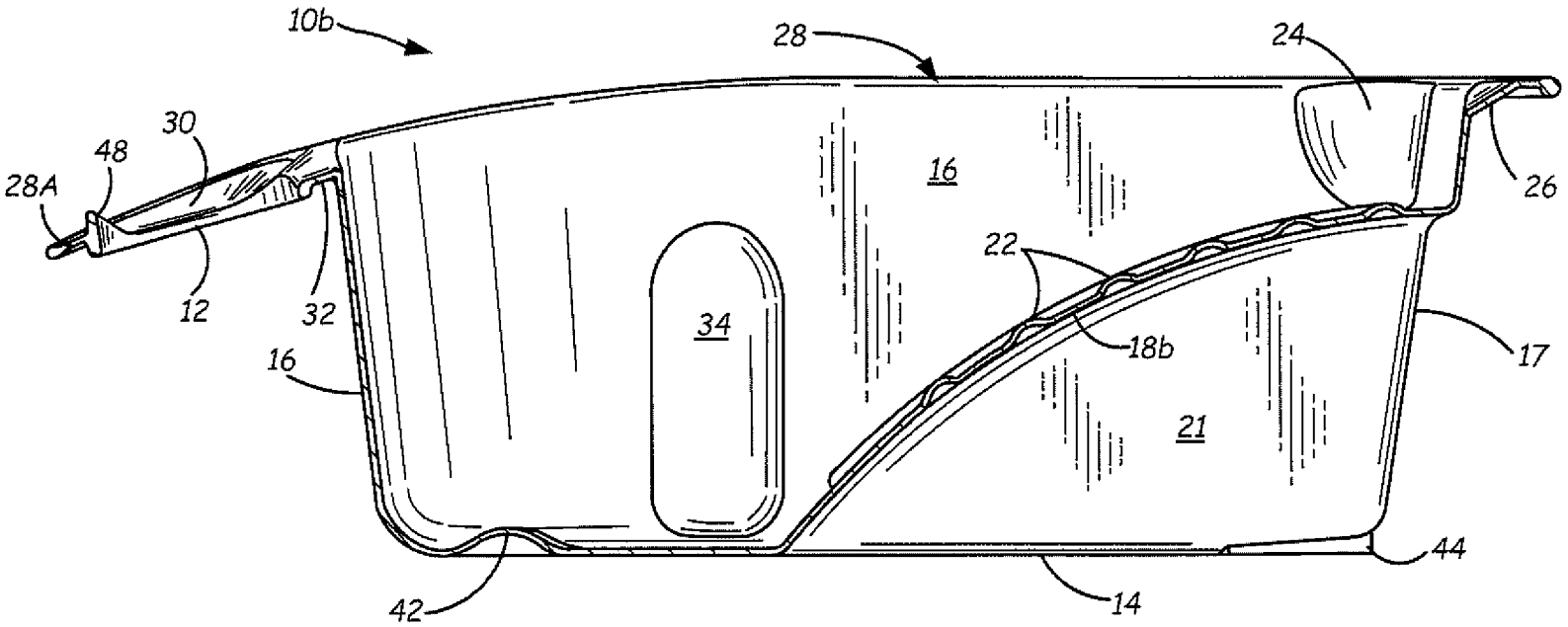
FIG. 10 is a cross-sectional elevation view taken through line 10-10 of FIG. 1B.
Figure 11:
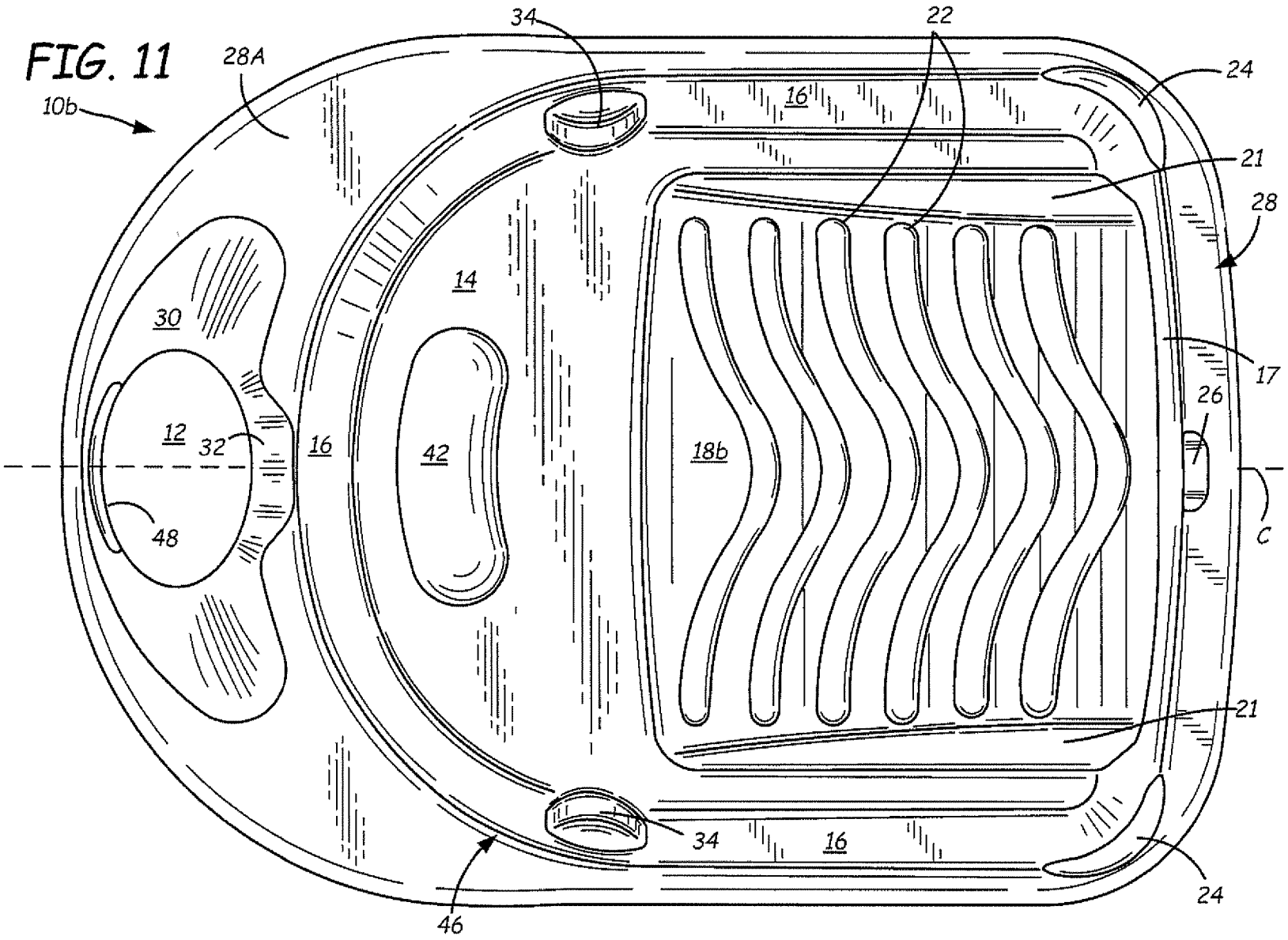
FIG. 11 is a top view of the container of FIG. 1B.
Figure 12:
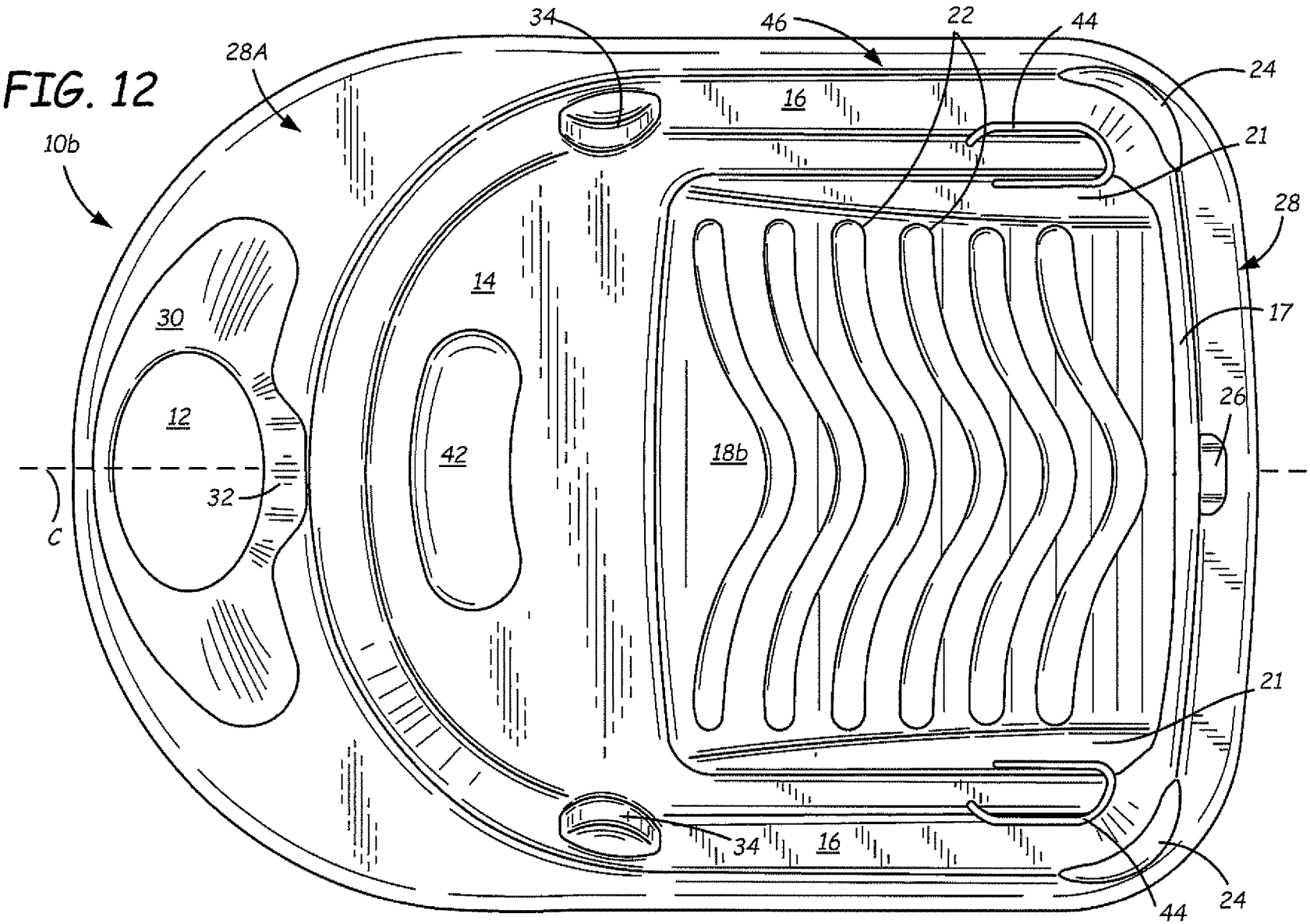
FIG. 12 is a bottom view of the container of FIG. 1B.

FIGS. 7 and 12 are bottom views of the containers 10*a*, 10*b*. Container 10*a*, 10*b* in exemplary embodiments includes foot rib 44, which lends structural integrity to bottom wall 14 and increases stability of container 10*a* on a resting surface.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

What is claimed is:

1. An apparatus including:

a bottom wall;

a plurality of connected walls attached to the bottom wall to define a cavity having a top rim; and a flange extending laterally outward from the top rim, wherein:

at least a portion of the flange extends downwardly from the top rim;

the portion of the flange includes an aperture configured to accept a user's thumb; and the portion of the flange is substantially symmetrical about a center line of the apparatus.

2. The apparatus of claim 1 wherein the apparatus is substantially symmetrical about the center line.

3. The apparatus of claim 1 further including a depression located on the flange, wherein the aperture is located on the depression.

4. The apparatus of claim 1 further including a notch on the top rim.

5. The apparatus of claim 4 wherein the notch connects the aperture and the cavity.

6. The apparatus of claim 1 further including a surface that extends laterally from at least one of the connected walls and below the top rim.

7. The apparatus of claim 6 further including a portion connected to the surface, wherein the portion does not extend a full width of the surface.

8. The apparatus of claim 7 wherein the portion includes a raised element.

9. The apparatus of claim 8 wherein the raised element is formed as a curvilinear ridge.

10. The apparatus of claim 9 wherein the curvilinear ridge includes a peak along the center line.

11. The apparatus of claim 6 wherein the surface extends from an end wall that is connected to two opposed outer side walls, and wherein a width of the surface is less than a distance between the two opposed outer side walls at the end wall.

12. The apparatus of claim 11 wherein two opposed inner side walls connect the surface to the bottom wall and end wall.

13. The apparatus of claim 1 formed as a single piece of material.

14. The apparatus of claim 1 further including a lip that extends upwardly from the portion of the flange at the aperture.

* * * * *